US006042368A

United States Patent [19]

Champion et al.

[11] Patent Number: 6,042,368

[45] Date of Patent: Mar. 28, 2000

[54] APPLIANCE FOR BURNING A COMBUSTIBLE GAS, AND METHOD OF BURNING SUCH A GAS

[75] Inventors: Marc Champion, La Tour de Salvagny; Gérard Scremin, Bron; Alain Huguet, Caluire et Cuire; Eric Carrato, Vaulx-Milieu, all of France; Thomas M. Benton, Wichita; Randall L. May, Andover, both of Kans.

[73] Assignee: The Coleman Company, Inc., Wichita, Kans.

[21] Appl. No.: 09/018,047

[22] Filed: Feb. 3, 1998

[51] Int. Cl.[7] ..... F23D 11/44

[52] U.S. Cl. ..... 431/247; 431/211; 431/354; 431/38; 431/11; 137/505.39

[58] Field of Search ..... 431/247, 211, 431/207, 37, 38, 157, 161, 344, 354, 11, 242; 126/38, 44; 137/505.39, 505.41, 505.42, 550

[56] References Cited

U.S. PATENT DOCUMENTS

| | | | |
|---|---|---|---|
| 2,868,224 | 1/1959 | Karlsson et al. | 137/505.42 |
| 3,512,912 | 5/1970 | Linch | 431/344 |
| 3,590,860 | 7/1971 | Stenner | 137/505.39 |
| 3,736,093 | 5/1973 | Bowman et al. | 431/344 |
| 3,840,321 | 10/1974 | Moench | 431/247 |
| 3,877,458 | 4/1975 | Allander | 431/247 |
| 3,907,490 | 9/1975 | Schaller | 431/142 |
| 3,994,674 | 11/1976 | Baumann et al. | 431/344 |
| 4,177,646 | 12/1979 | Guadagnin et al. | 431/344 |
| 4,408,630 | 10/1983 | Armstrong | 137/340 |
| 4,734,029 | 3/1988 | Newman | 431/211 |
| 4,923,394 | 5/1990 | Fumino | 431/344 |
| 5,601,357 | 2/1997 | Rangarajan | 431/344 |
| 5,803,727 | 9/1998 | Long | 126/38 |

FOREIGN PATENT DOCUMENTS

| | | |
|---|---|---|
| 0 703 409 A1 | 3/1996 | European Pat. Off. . |
| 2 182 417 | 12/1973 | France . |
| 2 208 506 | 6/1974 | France . |
| 2 612 610 | 9/1988 | France . |
| 37 18994 A1 | 12/1988 | Germany . |
| 2 182 765 A | 5/1987 | United Kingdom . |

*Primary Examiner*—Ira S. Lazarus
*Assistant Examiner*—Josiah C. Cocks
*Attorney, Agent, or Firm*—Kramer Levin Naftalis & Frankel LLP

[57] ABSTRACT

An appliance for burning a combustible gas, for example a liquefied petroleum gas. The appliance includes a relatively massive metal body forming a heat sink, in which there is formed a passage for flow of the combustible gas from a feed inlet to a discharge outlet. A control member controls the flow rate of the combustible gas. A mixing member for mixes primary air in with a stream of the combustible gas in a gaseous phase in order to obtained a mixture that can be burned. A burner burns the mixture to be burned, and is in thermal connection with the metal body. The control member includes a pressure reducer, at least partially incorporated into the metal body. The pressure reducer includes a chamber into which the combustible gas is admitted in a liquid phase at high pressure, and a chamber from which the gas is discharged at low pressure, at least partially in the gaseous phase. The chambers are formed in the metal body. The pressure reducer also includes a valve situated for the most part within the metal body.

27 Claims, 2 Drawing Sheets

APPLIANCE FOR BURNING A COMBUSTIBLE GAS, AND METHOD OF BURNING SUCH A GAS

BACKGROUND OF THE INVENTION

The present invention relates to a burning appliance for burning a combustible gas, in applications including stoves, heating appliances, lighting appliances, welding appliances, etc.

The term "burning appliance, appliance for burning and appliance" is intended to cover various appliances, which have the common characteristic of using the burning of a combustible gas to generate heat, but which can in other respects be differentiated in terms of their applications including stoves, heating appliances, lighting appliances, welding appliances, etc.

DESCRIPTION OF THE RELATED ART

The Assignee hereof manufactures and sells under the trade marks of MAX XTREME™, XPEDITION™ and XPERT™ a line of portable stoves for camping and hiking. The burners on such stoves are supplied with the combustible gas in the liquid phase from a fuel can under pressure. The liquid fuel changes phase to the gaseous phase within the stove and burns the in the gaseous phase.

Appliances of this kind in general comprise:

(i) a relatively massive metal body forming a heat sink, in which there is formed a passage for the flow of the combustible gas from an inlet to which it is fed under pressure, to an outlet from which it is discharged in the gaseous phase;

(ii) a member forming also a heat sink, namely a tap, for controlling the flow rate of the combustible gas, preferably in liquid phase, flowing down the aforementioned flow passage; this control member is separate from and connected to the metal body by a flexible pipe;

(iii) a member for mixing primary air in which a stream of the combustible gas in the gaseous phase, obtained at the outlet for discharging in the gaseous phase, in order to obtain a mixture that can be burned; and (iv) a burner for burning the mixture to be burned, thermally connected with the metal body.

The expression "relatively massive" means that the mass of the metal body is greater than that strictly needed from which to hollow out the combustible gas flow passage.

The expression "heat sink" means the property whereby the metal body can store up heat, on account of its mass, especially by heat exchange with its surroundings.

The term "in thermal connection with" means any arrangement whereby the burner can exchange heat with the metal body, mainly by conduction and/or radiation; an arrangement of this kind may include mounting the burner directly to the metal body.

Although the aforementioned appliances are quite satisfactory, their performance at the time of lighting could be improved, at low temperatures, for example down to −5° C., and/or when using a combustible gas which contains a relatively significant fraction of light hydrocarbons, for example a 60/40% butane/propane mixture. Such conditions often lead to incomplete vaporization of the combustible gas, which can affect the performance of said appliances and result in flaring.

For this type of appliance it has been proposed, in accordance with document EP-A-0 703 409, that the vaporization can be improved by providing and arranging a vaporization loop, connected to the combustible gas flow passage and arranged on and outside the metal body, extending close to the burner and in a heat exchange relationship therewith.

An arrangement of this kind can substantially improve vaporization only during operation, but not when the appliance is being started or lit.

SUMMARY OF THE INVENTION

For an appliance supplied with combustible gas in the liquid phase, the present invention is an arrangement that makes it possible to improve the degree of vaporization of the combustible gas, particularly when starting or lighting the appliance.

In accordance with one aspect of the invention, to this end, the control member includes a pressure reducer, at least partially incorporated into the metal body and comprising a chamber into which the combustible gas is admitted in the liquid phase at high pressure, and a chamber from which said gas is discharged at low pressure, at least partially in the gaseous phase, these chambers being formed in the metal body, together with a valve situated for the most part within the metal body.

Using a suitable experimental procedure, and for a flow rate of combustible gas (60/40% a butane/propane mixture) of the order of 240 g/h, at −5° C., it was demonstrated in an appliance according to the present invention, and with all other aspects unchanged, the phenomenon of flaring, explained earlier, is avoided, or in any case limited to an acceptable level.

In accordance with another aspect of the invention, two unexpected advantages, which have been confirmed experimentally, are also provided.

Firstly, another phenomenon known as fogging, which arises out of the burning of a combustible gas, which is supplied in the liquid phase, is reduced. Under some circumstances, when the pressure of the combustible gas in the liquid phase increases substantially, the gas may be discharged from the burner in an atomized form, that is to say in the form of a suspension of droplets in a gaseous phase. This is the phenomenon known as fogging, which can significantly disrupt the operation of the burner.

In accordance with one aspect of the invention, the aforementioned phenomenon practically disappears or in any case is confined within acceptable limits.

In accordance with another aspect of the invention, a relatively stable or constant operation is achieved, when the flow rate of combustible gas is relatively low, and when the heat transferred from the burner to the metal body remains limited.

In accordance with yet another aspect of the invention, the pressure reducer comprises a valve of the upstream type, that is to say a shutter situated in the inlet chamber and returned toward a seat.

According to this arrangement, operation is improved for two reasons:

(i) any increase in pressure in the inlet results in a corresponding relative reduction in the reduced pressure in the discharge chamber, and this makes the appliance self regulating; and (ii) any overpressure of the combustible gas in the liquid phase causes the valve of the pressure reducer to close, and therefore closes the pressure reducer; in particular, the pressure reducer is designed so that the overpressure at which it closes is fixed at a value, which is lower than the pressure that would cause deformation of the use-once or disposable container.

The solution according to the present invention also provides the following additional advantages:

(i) By working at a relatively low or reduced pressure, larger passage crosssections can be used, especially in the injector of the means for mixing in primary air, and this avoids or limits the phenomenon of blocking, and increases the life of the burning appliance. This advantage is very relevant to a burner, in which gas is supplied in the liquid phase, because the impurities conveyed in the liquid becomes deposited in the appliance as the combustible gas vaporizes.

(ii) The appliance is made more compact, and this allows a relatively short reaction time during movements of the pressure reducer, and in particular allows the burner to be extinguished in a relatively short period of time.

BRIEF DESCRIPTION OF THE DRAWINGS

The present invention is now described with reference to the appended drawings, in which.

DESCRIPTION OF THE PREFERRED EMBODIMENT(S)

Figure 1:
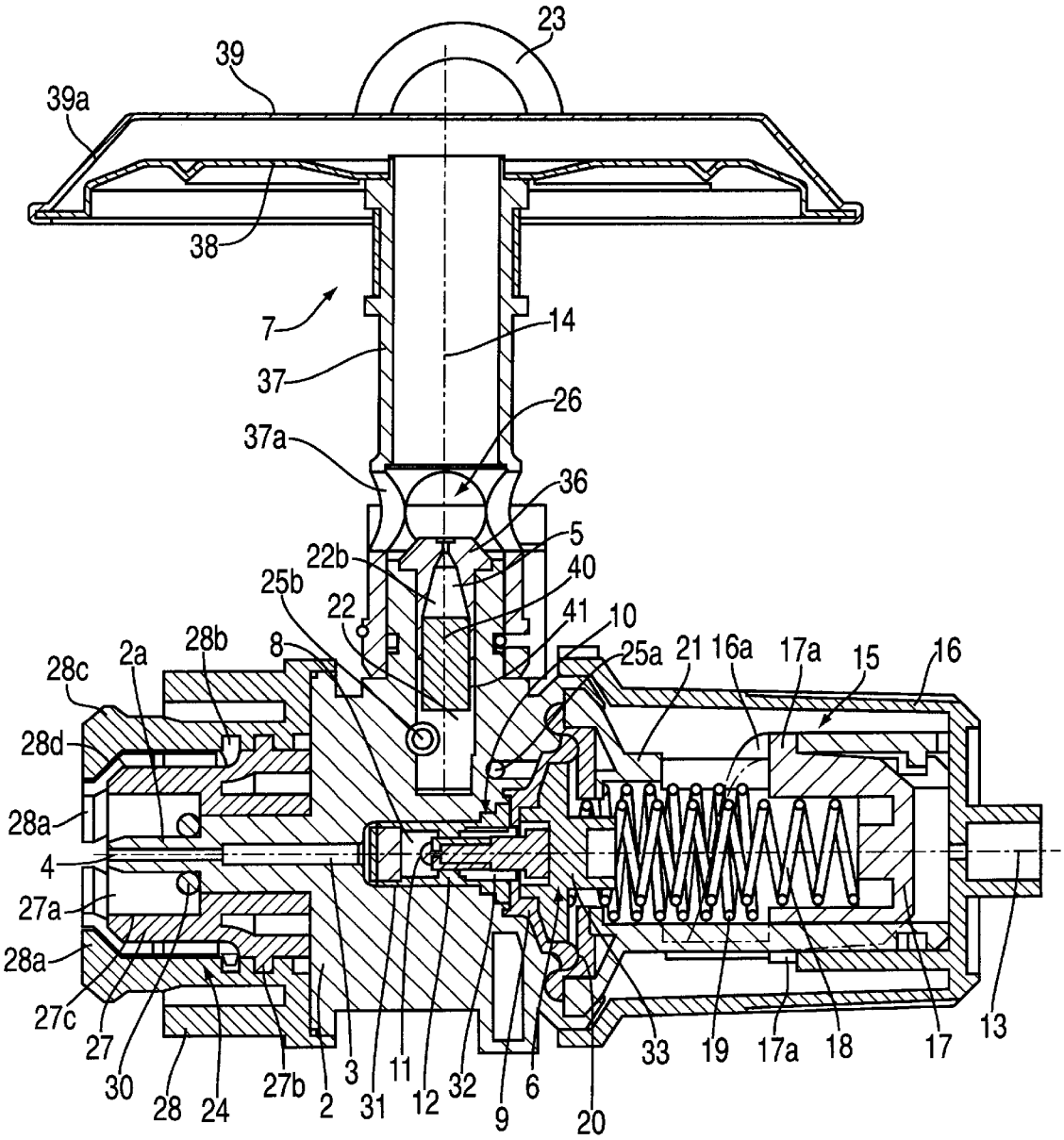
FIG. 1 is a view in vertical section through a burning appliance according to an embodiment of the present invention.
Figure 2:
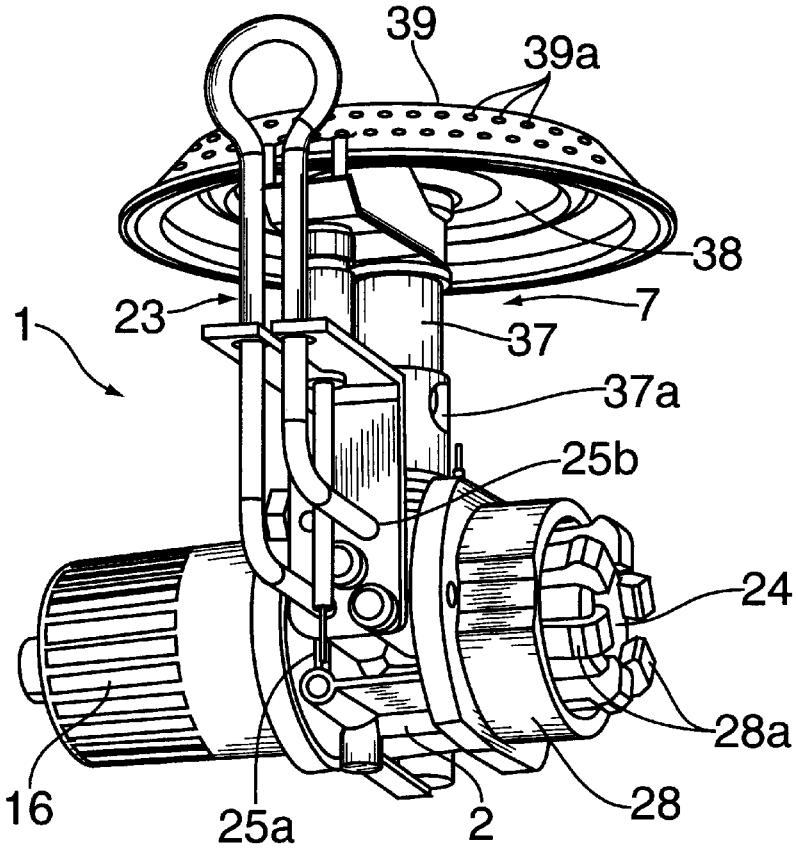
FIG. 2 is a perspective view of the appliance depicted in FIG. 1.

In accordance with FIGS. 1 and 2, there is depicted, identified in general terms by the numerical reference 1, a stove, forming an appliance or device for burning a combustible gas, for example a liquefied petroleum gas, especially butane and/or propane.

In general terms, the appliance 1 comprises:

(i) a relatively massive metal body 2 both forming the framework of the appliance and serving as a heat sink, in the sense that this metal body is, on the one hand, a good conductor of heat and, on the other hand, on account of its mass allows heat to be accumulated or stored;

(ii) a member 6 for controlling the flow rate of the combustible gas, including a pressure reducer or regulator, partially incorporated into the metal body 2;

(iii) a member 26 for mixing primary air in with a stream of the combustible gas in the gaseous phase in order to obtain a mixture that can be burned;

(iv) a burner 7 for burning the mixture to be burned, in the gaseous form; and (v) a means 24 of connecting the appliance 1 to a source of combustible gas in liquefied form and under pressure; in this case, but not depicted, this source includes a disposable container of the canister type comprising a valve, for drawing off liquid fuel. The valve is of an aerosol valve type, comprising a pedestal with a polygonal crosssection, for example a hexagonal crosssection, which will be discussed later; the connector means is covered in another text by the Assignee hereof (U.S. patent application Ser. No. 08/905,797, filed Aug. 12, 1997, incorporated herein by reference), and makes it possible to open the container, using its withdrawing valve, and to provide a sealed connection between the container and the appliance, and to fix the container to the appliance positively and reversibly.

In operation, the appliance 1 defined earlier has the particular feature of being fed with combustible gas in the liquid phase and at a relatively high pressure, and of burning this same combustible gas in the gaseous phase and at a relatively low or reduced pressure.

The various parts or components identified earlier will now be described.

The metal body 2 is designed, in general, to form a passage 3 down through which the combustible gas can flow, in the liquid and/or gaseous phase, from a liquid-phase feed inlet 4 to a gaseous phase discharge outlet 5. The metal body 2 has a protruding appendage 2*a* inside which there is formed a duct 4 forming the feed inlet for the combustible gas in liquid form and under pressure. A settling well 22, the crosssection of which is relatively larger than the mean crosssection of the flow passage 3, is formed in the metal body 2 and forms part of the passage 3. The upper end 22*b* of this well coincides with the outlet 5 for discharging the combustible gas in the gaseous phase at reduced pressure, as described below.

The connector means 24, in the illustrated embodiment, by way of example, includes a collet 28 including a tapped internal thread 28*b*, and mounted so that it cannot rotate on the metal body 2, and including pawls 28*a* distributed and spread out about its axis. The pawls 28*a* have, on the one hand, a nose 28*c* designed to be snap-fastened pushed inside a collar provided in a corresponding way on the disposable container, and more precisely on the valve, and on the other hand an oblique contact surface 28*d*, designed to cooperate with a corresponding oblique contact surface 27*c* of a cam 27 described below. The cam 27 is mounted so that it can rotate freely inside the collet 28, including a chamber 27*a* having a polygonal cross-section, for example a hexagonal crosssection, in which the appendage 2*a* described earlier is contained and including the liquid-phase feed duct 4. This cam 27 has an external screw thread 27*b* in mesh with the tapped internal thread 28*b* of the collet 28.

In relation to the structure of the container described earlier, and in particular the polygonal crosssection of the pedestal of its valve, the operation of the connector means 24 can be deduced from the earlier description, starting from the position depicted in FIG. 1. The container is attached to the appliance 1, on the one hand by snap-fastening the pawls 28*a* under the annular collar of the valve, and on the other hand by inserting the pedestal of the latter in the chamber 27*a*. As soon as this attachment has taken place, and in particular due to the seal 30, the valve of the container is opened, and a sealed connection is made between the open container and the appliance. Using the canister, it is possible to screw the moving cam 27 with respect to the stationary collet 28, move the cam and the collet closer together in terms of translation, and bring the oblique contact surfaces 27*c* and 28*d* into contact. From this moment on, the pawls 28*c* are pushed out positively under the annular collar of the valve of the disposable container and the latter becomes locked in a leaktight manner to the appliance 1. The foregoing steps are completely reversible.

The regulator or pressure reducer 6 or control member is characterized by the fact that it is integrated or incorporated at least in part into the metal body 2 of the appliance. The pressure reducer 6 is preferably, but not exclusively, a pressure reducer with a valve 10 of the upstream type, that is to say a pressure reducer in which the valve or shutter 11 is situated in the inlet chamber for the combustible gas at high pressure, being returned toward the seat 12.

In accordance with the embodiment shown in FIG. 1, the control member 6 comprises:

(i) a body 31 inserted in the metal body 2, determining the aforementioned seat 12;

(ii) a chamber 8 into which the combustible gas is admitted in the liquid phase at high pressure, determined both in the body 31, and therefore in the metal body 2;

(iii) a chamber 9 from which the combustible gas is discharged at low pressure, at least partially in the gaseous phase, formed in the metal body 2;

(iv) the valve 10 of the upstream type, which combines the shutter 11 with its seal, and the seat 12 against which said shutter is returned by a spring 32;

(v) a diaphragm 20, closing the discharge chamber, the circular edge of which is clamped between the metal body 2 and an outer bonnet 21 mounted on said body;

(vi) a cap 33, integral with or fixed to the diaphragm 20, resting against the end of the shutter 11 at the opposite end to the seat 12;

(vii) a spring 18, resting at one end against the cover 33, outside the discharge chamber 9, and at the other end against a slide 17, mounted freely and axially inside the bonnet 21; and (viii) an operating member 15, situated outside the metal body 2 and comprising at least two marked positions, one in which the valve 10 is open and in which the pressure of the combustible gas leaving the discharge chamber is controlled, and the other a closed position in which the valve 10 is locked in the closed position; this operating member 15 combines, first of all the bonnet 21 described earlier, mounted on the metal body 2; secondly, the slide 17 mounted so that it can move freely in terms of translation within the bonnet 21, resting against the means or spring 18 for returning the diaphragm 20; thirdly a means or spring 19 for returning the slide 17, away from the diaphragm 20 of the pressure reducer, resting at one end against the bonnet 21 and at the other end against the slide 17; and fourthly a means for actuating the slide 17 in terms of translation, composed of a knob 16, mounted so that it can rotate freely coaxially on the bonnet 21 and comprising two symmetric ramps 16*a* in rotation with respect to the axis 13 and in contact respectively with two opposed studs 17*a* of the slide 17.

Various positions of adjustment may be formed on the symmetric ramps 16*a* between the two marked, open and closed, positions of the operating member 15.

As clearly shown in FIG. 1, the inlet chamber 8 of the illustrated embodiment is immediately adjacent to the liquid phase inlet 4, and this has the advantage of limiting the amount of combustible gas that remains in the appliance and is vented to atmosphere when a disposable container is disconnected from said appliance as described earlier. Furthermore, this chamber 8 is preferably immediately adjacent to the axis 14 of the burner, which places it, at least partially, in the region for heat transfer from the burner 7.

Further, the feed duct 4 is preferably aligned along an axis 13 with an axis of the pressure reducer 6, and more precisely with an axis of the valve 11. The axis 13 is itself preferably orthogonal or perpendicular to the axis 14 of the well 22 described earlier, which also corresponds to that of the outlet 5, through which the combustible gas is discharged in the gaseous form, of the injector 36, and of the burner 7 described below.

Figure 3:
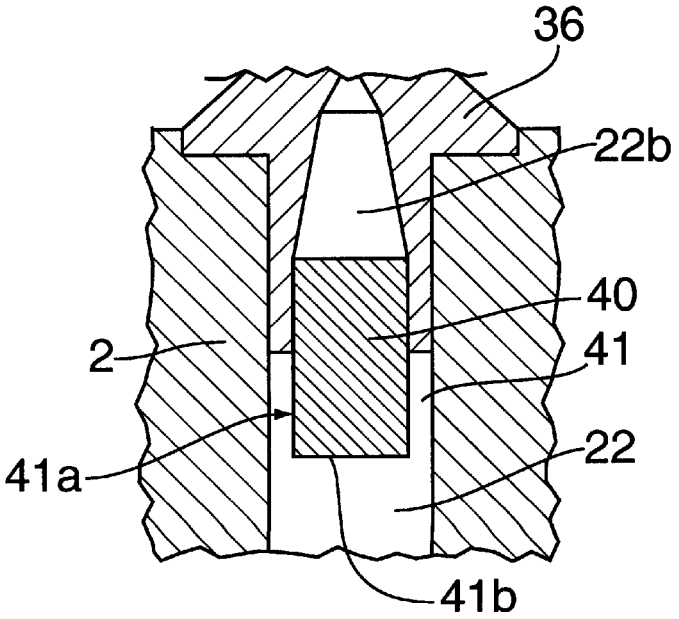
FIG. 3 is a detail of FIG. 1, illustrating a filter for filtering the combustible gas.

As shown more specifically in FIG. 3, a filter 40 can be placed in the well 22 immediately upstream of the member 26 for letting in primary air, in the direction in which the combustible gas flows. This filter is more particularly push-fitted into a hole formed in the injector 36, facing the well 22. The filter 40 and the well 22 are arranged one with respect to the other in such a way as to form a peripheral gap 41 between the wall of the well and a lateral part 40*a* of the filter, so that the filter 40 is arranged like a suction strainer. As a preference, the filter consists of a cylinder or plug of a sintered and therefore porous material (especially a metal). By varying the height of the filter 40 from the injector 36, the size of the lateral area 40*a* of the filter and therefore the time that the filter takes to block can be altered, all other things being equal. The upstream face 41*b* of the filter 40 is situated some distance from the lower end 22*a* of the well 22, as close as possible to the injector 36.

The member 26 for mixing in primary air combines, on the one hand, the injector 36 situated at the outlet 22*b* of the well 22, and on the other hand, openings 37*a* made in the tube 37 of the burner 7. The jet of combustible gas emitted by the injector 36 therefore entrains through the orifices 37*a* the primary air needed for combustion.

The burner 7 comprises two pressed parts 38 and 39 crimped together, forming a gap between them in which the mixture to be burned can circulate, the part 39 having perforations 39*a*.

A vaporization loop 23 outside the metal body 2 is preferably connected to the flow passage 3 for the combustible gas, in the direction in which this gas flows, between an intermediate inlet 25*a* consisting of an orifice made in the metal body 2, communicating with the discharge chamber 9, and an intermediate outlet 25*b* entering the well 22 some distance from its lower end 22*a* and approximately tangent to the circumference or cylindrical interior surface of the well 22.

These arrangements make it possible for heavy impurities liable to be deposited upon vaporization of the combustible gas, particularly by the swirling effect of the stream of gas in the well 22 to be held in the bottom of the well 22, which lies on the axis 14 of the burner.

The vaporization loop 23 is preferably designed to be removable from the metal body 2, and in particular from the inlet 25*a* and outlet 25*b*, which allows the loop to be adapted to suit the various configurations or arrangements of the burner 7, depending on the application or intended use of the appliance, without having to change the rest of said appliance.

This vaporization loop 23 plays a part in conducting the residual heat emitted by the burner 7 away to the metal body 2.

Because of what has been described earlier, and in operation, from being drawn off in the liquid phase and at high pressure from a disposable container, it will be appreciated by those skilled in the art that the flow of combustible gas in the illustrated embodiment is as follows:

(i) Entry in the liquid phase and at high pressure into the inlet chamber 8, possibly after filtration; the high pressure is, for example, 1 to 9 bar;

(ii) Controlled pressure reduction in the liquid phase across the valve 10, and passage of the combustible gas at low pressure into the discharge chamber 9, at least partially in the gaseous phase;

(iii) Entry and circulation of the combustible gas into and in the vaporization loop 23 and return of the combustible gas, entirely in the gaseous phase, to the well 22;

(iv) Passage of the combustible gas in the gaseous phase and at low pressure through the upper end 22*b* of the well 22, which communicates with the member 26 for mixing in primary air, namely the injector 36 from which a stream of the combustible gas is obtained;

(v) The mixture to be burned is obtained by mixing the stream of combustible gas with primary air and said mixture is burned in the burner 7.

All the aforementioned provisions make it possible to provide a significant improvement, as described earlier, to the operation of a burner, which burns in the gaseous phase, but is supplied with combustible gas in the liquid phase.

While the present invention has been described with respect to what is presently considered to be the preferred embodiments, it should be understood that the invention is not limited to the disclosed embodiments. To the contrary, the invention is intended to cover various modifications and equivalent arrangements, some of which are discussed above, included within the spirit and scope of the appended claims. Therefore, the scope of the following claims is intended to be accorded the broadest reasonable interpretation so as to encompass all such modifications and equivalent structures and functions.

What is claimed is:

1. An appliance for burning a combustible gas, comprising:

a relatively massive metal body forming a heat sink, in which there is formed a passage for a flow of the combustible gas, said flow passage including an inlet to which the combustible gas is fed in a liquid phase, and an outlet, from which the combustible gas is discharged in a gaseous phase;

a control member for controlling a flow rate of the combustible gas flowing down said flow passage;

a mixing member for mixing primary air in with a stream of the combustible gas in the gaseous phase, discharged from the outlet, in order to obtain a mixture that can be burned; and wherein, said control member comprises a pressure reducer, at least partially incorporated into said metal body and comprising an inlet chamber into which the combustible gas is admitted in the liquid phase at high pressure, a discharge chamber from which said gas is discharged at low pressure, at least partially in the gaseous phase, the inlet and discharge chambers being formed in said metal body, and a valve disposed between the inlet and discharge chambers, situated mainly within said metal body, and wherein the inlet chamber is immediately adjacent to the inlet of the flow passage.

2. The appliance according to claim 1, wherein said valve is of an upstream type, comprising a shutter situated in the inlet chamber and returnable toward a seat.

3. The appliance according to claim 1, wherein the pressure reducer further comprises an operating member for operating on said valve, situated outside said metal body and movable between at least two positions, one an open position in which said valve is open and in which the pressure of the combustible gas leaving the discharge chamber is controlled, and another a closed position in which said valve is locked closed.

4. The appliance according to claim 3, wherein the pressure reducer further comprises a diaphragm, closing the discharge chamber, and means for returning said diaphragm, and said operating member comprises:

a bonnet, mounted on said metal body;

a slide mounted to move freely in terms of translation within the bonnet, resting against the means for returning said diaphragm of said pressure reducer;

means for returning said slide, away from said diaphragm of said pressure reducer; and means for actuating said slide in translation, comprising (i) a knob mounted to rotate freely on the bonnet and compressing a ramp and (ii) a stud extending from said slide and contacting said ramp.

5. The appliance according to claim 1, wherein said metal body further includes a well formed therein which communicates at a lower end thereof with the pressure reducer discharge chamber, and at an upper end thereof with the outlet.

6. The appliance according to claim 5, further comprising a vaporization loop connected in flow communication to the flow passage intermediate the flow passage inlet and outlet, said vaporization loop extending from an intermediate inlet to an intermediate outlet in the direction in which the combustible gas passes, and extending in an axial direction of and close to the burner, so as to have a heat-exchange relationship therewith.

7. The appliance according to claim 6, wherein the intermediate outlet enters said well some distance from the lower end of said well.

8. The appliance according to claim 6, wherein the intermediate outlet enters said well at a tangent to a circumference thereof.

9. The appliance according to claim 6, wherein said vaporization loop is removably attached to said metal body.

10. The appliance according to claim 5, further comprising a filter in said well immediately upstream of the member for mixing in primary air, in the direction in which the combustible gas flows.

11. The appliance according to claim 10, wherein said filter and said well are situated one with respect to the other in such a way as to form a peripheral gap between an interior wall of said well and part of a lateral surface of said filter.

12. The appliance according to claim 10, wherein an upstream face of said filter is situated some distance from the lower end of said well.

13. The appliance according to claim 1, wherein the inlet chamber is adjacent to an axis of said burner.

14. A method for burning a combustible gas comprising the steps of:

providing the combustible gas in a liquid phase under pressure;

drawing off said gas in the liquid phase;

vaporizing the drawn gas in order to obtain a stream of the combustible gas in a gaseous phase;

mixing the stream of combustible gas with primary air in order to obtain a mixture that can be burned;

burning the mixture; and venting any combustible gas in a liquid phase that may remain, wherein the vaporization step includes subjecting the combustible gas to a pressure reduction in order to obtain said combustible gas at least partially in the gaseous phase at relatively low pressure, from which the stream of combustible gas is obtained for mixing with the primary air.

15. An appliance for burning a combustible gas, comprising:

a metal body that is relatively massive so as to serve as a heat sink, and in which there is formed an inlet chamber into which the combustible gas is admitted in a liquid phase at high pressure, a discharge chamber downstream of the inlet chamber, and an outlet downstream of the discharge chamber and from which a stream of the combustible gas is discharged in a gaseous phase;

a valve, through which the combustible gas flows from the inlet chamber to the discharge chamber, situated substantially within the metal body, for regulating a flow rate of the combustible gas so that the combustible gas in the discharge chamber is at low pressure and at least partially in the gaseous phase;

a mixing member for mixing primary air with the stream of the combustible gas discharged from the outlet, in order to obtain a mixture to be burned; and a burner for burning the mixture to be burned, the burner being thermally connected with the metal body, wherein the metal body includes an inlet to which the combustible gas is fed in the liquid phase and wherein the inlet chamber is immediately adjacent to the inlet.

16. The appliance according to claim 15, wherein the valve is an upstream type, comprising a shutter, situated in the inlet chamber, and a seat, toward which the shutter is returnable.

17. The appliance according to claim 15, further comprising an operating member for operating on the valve, the operating member being situated outside the metal body and movable between at least an open position, in which the valve is open and in which the pressure of the combustible gas leaving the discharge chamber is controlled, and a closed position, in which the valve is locked closed.

18. The appliance according to claim 17, further comprising a diaphragm, closing the discharge chamber, and means for returning the diaphragm, and wherein the operating member comprises:

a bonnet, mounted on the metal body;

a slide, mounted to translate within the bonnet, and resting against the means for returning said diaphragm;

means for returning the side, away from the diaphragm; and means for actuating translation of the slide, comprising (i) an actuator mounted to rotate on the bonnet and comprising a ramp and (ii) a stud extending from the slide and contacting the ramp.

19. The appliance according to claim 15, wherein the metal body further includes a well formed therein having a lower end, in flow communication with the discharge chamber, and an upper end, in flow communication with the outlet.

20. The appliance according to claim 19, further comprising a filter in the well upstream of the outlet.

21. The appliance according to claim 20, wherein the filter and the well are juxtaposed so as to define a peripheral gap between an interior wall of the well and a lateral surface of the filter.

22. The appliance according to claim 20, wherein and upstream face of the filter is spaced from the lower end of the well.

23. The appliance according to claim 15, further comprising a vaporization loop intermediate of and in flow communication with the discharge chamber and the outlet, the vaporization loop extending from the metal body and passing close to the burner, so as to have a heat-exchange relationship therewith.

24. The appliance according to claim 23, wherein the metal body further includes a well formed therein, the vaporization loop emptying into the well at a distance from a lower end of the well, and the well having an upper end in flow communication with the outlet.

25. The appliance according to claim 23, wherein the metal body further includes a well formed therein, the vaporization loop emptying into the well substantially at a tangent to an interior wall of the well, and the well having an upper end in flow communication with the outlet.

26. The appliance according to claim 23, wherein the vaporization loop is removably attached to the metal body.

27. The appliance according to claim 15, wherein the inlet chamber is adjacent to an axis of the burner.

* * * * *